US006196399B1

(12) United States Patent
Pacheco

(10) Patent No.: US 6,196,399 B1
(45) Date of Patent: Mar. 6, 2001

(54) MULTIPLE CLOTHESLINE HANGER HOLDER DEVICE

(76) Inventor: Rose Marie Y. Pacheco, 1609 E. 15th St., Pueblo, CO (US) 81001

( * ) Notice: Subject to any disclaimer, the term of this patent is extended or adjusted under 35 U.S.C. 154(b) by 0 days.

(21) Appl. No.: 09/106,643

(22) Filed: Jun. 29, 1998

(51) Int. Cl.[7] ..... A47F 5/08
(52) U.S. Cl. ..... 211/113
(58) Field of Search ..... 211/113, 123, 211/105.1

(56) References Cited

U.S. PATENT DOCUMENTS

| | | | | |
|---|---|---|---|---|
| 2,092,121 | | 9/1937 | Johnson | 24/259 |
| 2,523,682 | * | 9/1950 | Corwin | 211/113 |
| 2,604,999 | * | 7/1952 | Sutton | 211/113 |
| 2,605,000 | * | 7/1952 | Tomarin | 211/113 |
| 2,915,274 | | 12/1959 | Gustitus | 248/317 |
| 2,980,383 | | 4/1961 | Anderson et al. | 248/317 |
| 3,085,691 | * | 4/1963 | Smith . | |
| 3,147,865 | | 9/1964 | Zimmerli et al. | 211/86 |
| 3,184,204 | | 5/1965 | Dachinger | 248/323 |
| 3,193,235 | | 7/1965 | Jensen | 248/317 |
| 3,731,809 | | 5/1973 | Saenger | 211/118 |
| 4,139,174 | | 2/1979 | Olson | 248/317 |
| 4,189,055 | | 2/1980 | Nohzuka | 211/119.12 |
| 4,415,093 | * | 11/1983 | Livingston | 211/113 |

* cited by examiner

*Primary Examiner*—Alvin Chin-Shue
*Assistant Examiner*—Sarah Purol

(74) *Attorney, Agent, or Firm*—Flanagan & Flanagan; John R. Flanagan; John K. Flanagan

(57) ABSTRACT

A multiple clothesline hanger holder device includes an elongated body made of a substantially rigid material and with a longitudinal length greater than a transverse width thereof. The elongated body is rigid or fixed in a configuration wherein it is folded towards itself along its longitudinal length. The elongated body includes an upper portion and a lower portion. The upper portion is tubular-shaped defining a channel extending the longitudinal length of the elongated body. The upper portion has a lower side, a pair of opposite open ends and a pair of spaced apart opposite lower edges defining a longitudinal slot therebetween extending along the lower side and the longitudinal length between the opposite open ends providing an entry to the channel such that a clothesline may be inserted through the slot and into the channel of the tubular-shaped upper portion resulting in the clothesline extending through the upper portion and in opposite directions from the opposite open ends thereof. The lower portion is substantially in the form of a pair of opposite flanges attached to and extending downwardly from the opposite edges of the longitudinal slot and along the lower side of the upper portion. The flanges are spaced apart, extend in parallel relation to one another along the longitudinal length of the elongated body, and define a passageway therebetween having a substantially uniform transverse width leading to the longitudinal slot. Each flange defines spaced apart holes therethrough aligned with like holes through the other flange permitting clothesline hangers to be inserted through respective pairs of the adjacent aligned holes on the flanges for hanging clothes on the clothesline.

18 Claims, 1 Drawing Sheet

MULTIPLE CLOTHESLINE HANGER HOLDER DEVICE

BACKGROUND OF THE INVENTION

1. Field of the Invention

The present invention generally relates to devices for hanging clothes and, more particularly, is concerned with a multiple clothesline hanger holder device.

2. Description of the Prior Art

It is often desirable to air dry clothing which is wet such as from a wash. Clotheslines are still widely used to dry garments in this way. An article of clothing may be hung directly on the clothesline but oftentimes marks will be left in the clothing. A preferred way is to employ a hanger to support the article of clothing which hanger is then hung directly on the clothesline.

Many clotheslines, however, are not taut and tend to sag or are otherwise flexible and thereby may cause hangers to slide laterally along the clothesline toward the center thereof which results in garments becoming clustered. Such grouping together of articles of clothing may inhibit the drying process. The movement of hangers occurs by the force of gravity toward the lowest point which is normally the center of the clothesline. Such movement may leave portions of the clothesline adjacent to its ends unusable.

A variety of devices have been developed over the years in an attempt to prevent movement of hangers along clotheslines and to thereby make the full length of a clothesline usable and to keep garments spaced from one another to enhance the drying process. Representative examples of these prior art devices and the like are disclosed in U.S. Pat. No. 2,092,121 to Johnson, U.S. Pat. No. 2,915,274 to Gustitus, U.S. Pat. No. 2,980,383 to Anderson et al., U.S. Pat. No. 3,085,691 to Smith, U.S. Pat. No. 3,147,865 to Zimmerli et al., U.S. Pat. No. 3,184,204 to Dachinger, U.S. Pat. No. 3,193,235 to Jensen, U.S. Pat. No. 3,731,809 to Saenger, U.S. Pat. No. 4,139,174 to Olson and U.S. Pat. No. 4,189,055 to Nohzuka. While these prior art devices appear to be satisfactory in use for the specific purposes for which they were designed, none of them seem to provide an optimum solution for the problem at hand.

Consequently, a need still exists for a device which provides a solution to the aforementioned problem in the prior art without introducing any new problems in place thereof.

SUMMARY OF THE INVENTION

The present invention provides a multiple clothesline hanger holder device designed to satisfy the aforementioned need. The multiple hanger holder device of the present invention has structural rigidity and has an elongated configuration. The multiple hanger holder device thereby retains garments on a clothesline spaced apart from one another and prevents hangers from sliding toward one another and the resulting clustering of garments. The multiple hanger holder device thereby improves the clothing drying process and allows the full length of the clothesline to be used for hanging garments.

Accordingly, the present invention is directed to a multiple clothesline hanger holder device, comprising an elongated body made of a substantially rigid material and having a transverse width and a longitudinal length greater than the transverse width and being fixed in a configuration wherein the elongated body is folded towards itself along its longitudinal length.

More particularly, the elongated body includes an upper portion and a lower portion. The upper portion of the elongated body is substantially in the form of a tube or is generally tubular-shaped and extends the full longitudinal length of the elongated body. The tubular shaped upper portion has a lower side, a pair of opposite open ends and a pair of spaced apart opposite lower edges defining a longitudinal slot extending along the lower side and extending the longitudinal length of the elongated body between the opposite open ends such that a clothesline may be inserted through the slot and into the tubular-shaped upper portion of the elongated body, resulting in the clothesline extending through the tubular-shaped upper portion and in opposite directions from the opposite open ends thereof.

The lower portion of the elongated body is substantially in the form of a pair of opposite flanges. The flanges are attached to and extend downwardly from the opposite lower edges of the tubular-shaped upper portion defining the longitudinal slot and along the lower side of the tubular-shaped upper portion. The flanges extend the longitudinal length of the elongated body and define a passageway therebetween leading to the longitudinal slot of the tubular-shaped upper portion. Each flange defines a plurality of spaced apart holes therethrough aligned with like holes through the other flange such that clothesline hangers may be inserted through respective pairs of adjacent aligned holes on the flanges for hanging clothes on the clothesline. Each flange also has a substantially flat configuration. The flanges are further in substantially parallel and uniformly spaced apart relation to one another. The passageway between the flanges thus has a substantially uniform transverse width throughout the longitudinal length of the elongated body.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
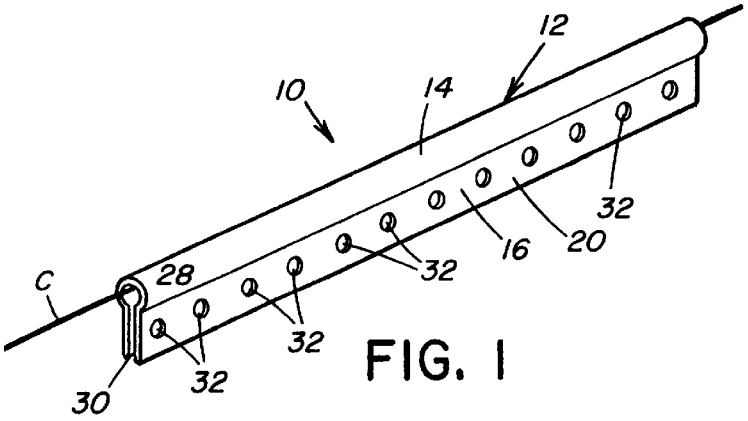
FIG. 1 is a perspective view of a multiple clothesline hanger holder device of the present invention.
Figure 2:
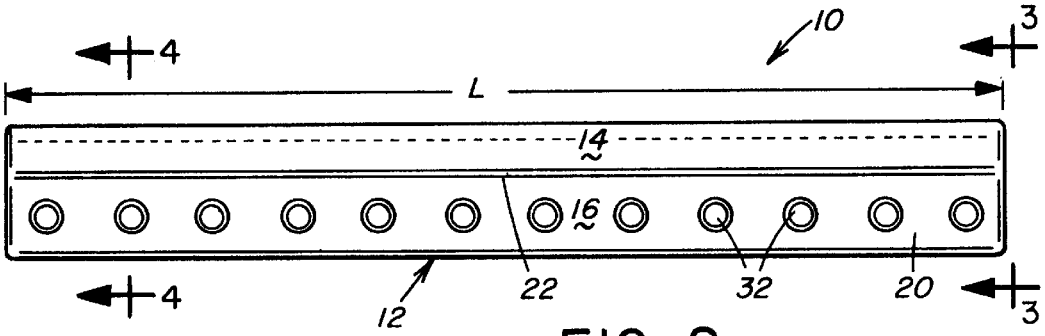
FIG. 2 is an enlarged side elevational view of the device shown in FIG. 1.
Figure 4:
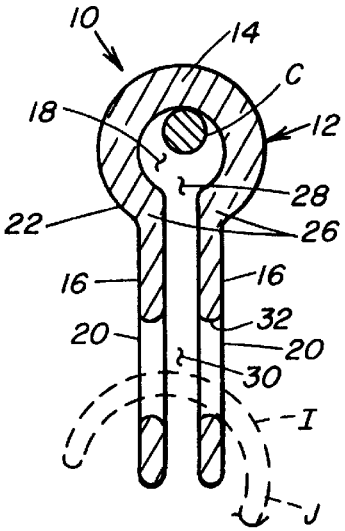
FIG. 4 is an enlarged transverse sectional view of the device taken along line 4—4 of FIG. 2.
Figure 3:
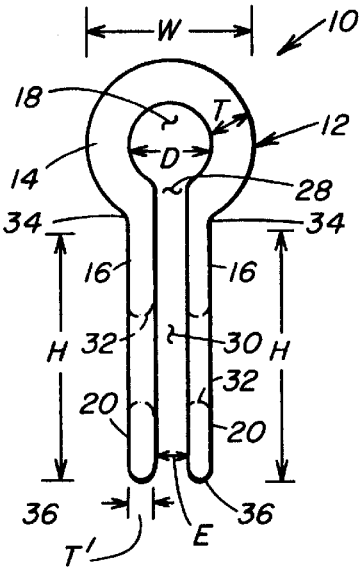
FIG. 3 is an enlarged end elevational view of the device as seen along line 3—3 of FIG. 2.

Referring to the drawings and particularly to FIG. 1, there is illustrated a multiple clothesline hanger holder device, generally designated 10, of the present invention. Basically, the multiple hanger holder device 10 includes an elongated body 12 having an upper portion 14 and a lower portion 16. The elongated body 12 is comprised of a substantially rigid material, such as metal or plastic. The elongated body 12 has an overall transverse width W and longitudinal length L. The longitudinal length L is greater than the transverse width W. The body 12 is rigid or fixed in a configuration wherein the elongated body 12 is folded onto or towards itself along its longitudinal length L. The upper portion 14 is substantially tubular-shaped defining a cylindrical channel 18 extending the entire longitudinal length L of the elongated body 12 for receiving a clothesline C therethrough. The lower portion 16 is substantially in the form of a pair of opposite flanges 20. One or more of the multiple hanger holder devices 10 may be used on the clothesline C.

Referring now to FIGS. 1 to 4, the tubular-shaped upper portion 14 of the elongated body 12 has a lower side 22, a pair of opposite open ends 24 and a pair of spaced apart opposite lower edges 26. The opposite lower edges 26 of the upper portion 14 define a longitudinal slot 28 extending along the lower side 22 and extending the entire longitudinal length L of the elongated body 12 between the opposite open ends 24 thereof so to provide entry into the elongated channel 18 such that the clothesline C may be inserted through the longitudinal slot 28 and into the channel 18 of the tubular-shaped upper portion 14, resulting in the clothesline C extending through the channel 18 of the upper portion 14 and in opposite directions from the opposite open ends 24 thereof. The tubular-shaped upper portion 14 has a transverse thickness T and a transverse width W which is equal to the maximum transverse width W of the elongated body 12. The tubular-shaped upper portion 14 may have any suitable size.

The pair of opposite flanges 20 of the lower portion 16 of the elongated body 12 are attached to and extend downwardly from the opposite lower edges 26 of the tubular-shaped upper portion 14 defining the longitudinal slot 28 and along the lower side 22 of the upper portion 14. The opposite flanges 20 extend the longitudinal length L of the elongated body 12 and define a passageway 30 therebetween leading to the longitudinal slot 28 of the tubular-shaped upper portion 14. The diameter D of the channel 18 through the upper portion 14 is larger than the width E of the passageway 30 through the lower portion 16.

Also, each flange 20 defines a plurality of spaced apart holes 32 therethrough being aligned with like holes 32 through the other flange 20 such that the upper hooks H of clothesline hangers C may be inserted through respective pairs of adjacent aligned holes 32 on the flanges 20 for hanging clothes on the clothesline C. Each flange 20 has a substantially flat configuration and a transverse thickness T'. The transverse thickness T of the tubular-shaped upper portion 14 is greater than the transverse thickness T' of each of the flanges 20. The transverse thickness T' of one flange 20 is substantially equal to the transverse thickness T' of the other flange 20. Each flange 20 of the lower portion 16 has a height H greater than the transverse width W of the tubular-shaped upper portion 14. The height H of each flange 20 is substantially equal to the height H of the other flange 20.

Each of the holes 32 through the flanges 20 has a substantially circular configuration, though may have any other suitable shape. Each flange 20 has a top 34 and a bottom 36. The holes 32 are spaced an equal distance from the top 34 as from the bottom 36 of the flanges 20. The holes 32 of the flanges 20 also are spaced an equal distance apart from one another along the longitudinal length L of the elongated body 12. The flanges 20 are preferably in substantially parallel and spaced apart relation to one another. The passageway 30 preferably has a substantially uniform transverse width throughout the longitudinal length L. The flanges 20 and passageway 30 may have any suitable size. It is readily apparent that pairs of adjacent aligned holes 32 through the flanges 20 and thus the clothes hangers inserted therethrough are fixed and thus held in their spaced apart relationship from one another along the longitudinal length L of the elongated body 12 due to the rigidity of the flanges 20.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A multiple clothesline hanger holder device, comprising:

(a) an elongated body made of a substantially rigid material and having a transverse width and a longitudinal length greater than said transverse width and being fixed in configuration;

(b) said elongated body including (i) an upper portion substantially tubular-shaped defining a channel extending said longitudinal length of said elongated body, said upper portion having a lower side, a pair of opposite open ends and a pair of spaced apart opposite lower edges defining a longitudinal slot therebetween extending along said lower side and extending said longitudinal length of said elongated body between said opposite open ends and providing an entry into said channel such that a clothesline may be inserted through said slot and into said channel of said fixed tubular-shaped upper portion of said elongated body, resulting in the clothesline extending through said channel of said upper portion and in opposite directions from said opposite open ends thereof, and (ii) a lower portion substantially in the form of a pair of opposite flanges attached to and extending downwardly from said opposite lower edges of said tubular-shaped upper portion defining said longitudinal slot therebetween and along said lower side of said tubular-shaped upper portion, said opposite flanges extending said longitudinal length of said elongated body and defining an open passageway therebetween and throughout leading to said longitudinal slot of said tubular-shaped upper portion, said channel of said upper portion having a diameter greater than a width of said open passageway of said lower portion, each of said flanges defining a plurality of spaced apart holes therethrough aligned with like said holes through the other of said flanges such that clothesline hangers may be inserted through respective pairs of adjacent aligned ones of said holes on said flanges for hanging clothes on the clothesline, said pairs of aligned holes through said flanges and thus the clothes hangers inserted therethrough being fixed and thus held in said spaced apart relationship from one another along said longitudinal length of said elongated body due to the rigidity of the material of said flanges.

2. The device of claim 1 wherein each of said flanges of said lower portion of said elongated body has a substantially flat configuration.

3. The device of claim 1 wherein said tubular-shaped upper portion and each of said flanges of said lower portion of said elongated body has a transverse thickness, said transverse thickness of said tubular-shaped upper portion being greater than said transverse thickness of one of said flanges.

4. The device of claim 1 wherein each of said flanges of said lower portion of said elongated body has a transverse thickness substantially equal to said transverse thickness of the other of said flanges.

5. The device of claim 4 wherein said tubular-shaped upper portion has a transverse thickness greater than said transverse thickness of each of said flanges of said lower portion of said elongated body.

6. The device of claim 1 wherein said tubular-shaped upper portion of said elongated body has a transverse width and each of said flanges of said lower portion of said elongated body have a height greater than said transverse width of said tubular-shaped upper portion of said elongated body.

7. The device of claim 1 wherein each of said flanges of said lower portion of said elongated body has a height substantially equal to said height of the other of said flanges.

8. The device of claim 7 wherein each of said flanges of said lower portion of said elongated body has a substantially flat configuration.

9. The device of claim 7 wherein said tubular-shaped upper portion of said elongated body has a transverse width less than said height of each of said flanges of said lower portion of said elongated body.

10. The device of claim 1 wherein each of said holes through said flanges of said lower portion of said elongated body has a substantially circular configuration.

11. The device of claim 1 wherein each of said flanges of said lower portion of said elongated body has a top and a bottom and said holes through said flanges are spaced an equal distance from said top as from said bottom of said flanges.

12. The device of claim 1 wherein said holes through said flanges of said lower portion of said elongated body are spaced an equal distance apart from one another along said longitudinal length of said elongated body.

13. The device of claim 12 wherein each of said holes through said flanges of said lower portion of said elongated body has a substantially circular configuration.

14. The device of claim 12 wherein each of said flanges of said lower portion of said elongated body has a top and a bottom and said holes through said flanges are spaced an equal distance from said top as from said bottom of said flanges.

15. A multiple clothesline hanger holder device, comprising:

(a) an elongated body made of a substantially rigid material and having a transverse width and a longitudinal length greater than said transverse width and being fixed in configuration;

(b) said elongated body including (i) an upper portion substantially tubular-shaped defining a channel extending said longitudinal length of said elongated body, said upper portion having a lower side, a pair of opposite open ends and a pair of spaced apart opposite lower edges defining a longitudinal slot therebetween extending along said lower side and extending said longitudinal length of said elongated body between said opposite open ends and providing an entry into said channel such that a clothesline may be inserted through said slot and into said channel of said fixed tubular-shaped upper portion of said elongated body, resulting in the clothesline extending through said channel of said upper portion and in opposite directions from said opposite open ends thereof, and (ii) a lower portion substantially in the form of a pair of opposite flanges attached to and extending downwardly from said opposite lower edges of said tubular-shaped upper portion defining said longitudinal slot therebetween and along said lower side of said tubular-shaped upper portion, said opposite flanges extending said longitudinal length of said elongated body and defining an open passageway therebetween and throughout leading to said longitudinal slot of said tubular-shaped upper portion, said channel of said upper portion having a diameter greater than a width of said open passageway of said lower portion, each of said flanges defining a plurality of spaced apart holes therethrough aligned with like said holes through the other of said flanges such that clothesline hangers may be inserted through respective pairs of adjacent aligned ones of said holes on said flanges for hanging clothes on the clothesline, said pairs of aligned holes through said flanges and thus the clothes hangers inserted therethrough being fixed and thus held in said spaced apart relationship from one another along said longitudinal length of said elongated body due to the rigidity of the material of said flanges, said flanges of said lower portion of said elongated body being disposed in a substantially parallel and spaced apart relation to one another and said passageway defined between said flanges having a substantially uniform transverse width throughout said longitudinal length of said elongated body.

16. The device of claim 15 wherein each of said flanges of said lower portion of said elongated body has a substantially flat configuration.

17. The device of claim 15 wherein each of said holes through said flanges of said lower portion of said elongated body has a substantially circular configuration.

18. The device of claim 15 wherein each of said flanges of said lower portion of said elongated body has a top and a bottom and said holes through said flanges are spaced an equal distance from said top as from said bottom of said flanges.

* * * * *